United States Patent [19]

Russell

[11] 4,274,565

[45] Jun. 23, 1981

[54] METHOD OF THREADING A LACING NEEDLE

[76] Inventor: Buel O. Russell, 6605 S. Hulen, Apt. 211, Fort Worth, Tex. 76133

[21] Appl. No.: 969,405

[22] Filed: Dec. 14, 1978

Related U.S. Application Data

[63] Continuation of Ser. No. 875,376, Feb. 6, 1978, abandoned.

[51] Int. Cl.[3] ..... D05B 85/00

[52] U.S. Cl. ..... 223/102

[58] Field of Search ..... 223/102

[56] References Cited

U.S. PATENT DOCUMENTS

| | | | |
|---|---|---|---|
| 487,040 | 11/1892 | Wieseckel | 223/102 |
| 1,070,941 | 8/1913 | Bell | 223/102 |
| 2,758,648 | 8/1956 | Dodds | 223/102 X |
| 3,987,839 | 10/1976 | Pace | 223/102 X |

FOREIGN PATENT DOCUMENTS

| | | | |
|---|---|---|---|
| 812285 | 4/1959 | United Kingdom | 223/102 |

*Primary Examiner*—Louis Rimrodt
*Attorney, Agent, or Firm*—James E. Bradley

[57] ABSTRACT

A lacing needle is disclosed herein that includes a pair of wire portions connected together at the ends. The wire portions are straight and parallel with each other, defining an elongated aperture or eye between them. The portions may be spread apart for threading leather lacing between them. The lacing may be drawn along the eye until bearing against the end opposite the point. The lacing is then trimmed flush with the side of the needle, with friction retaining it to the needle. The needle is made by bending a straight piece of wire in half, then joining the ends.

2 Claims, 3 Drawing Figures

METHOD OF THREADING A LACING NEEDLE

CROSS REFERENCE TO RELATED APPLICATION

This is a continuation application of Ser. No. 875,376 filed Feb. 6, 1978, now abandoned.

BACKGROUND OF THE INVENTION

1. Field of the Invention

This invention relates in general to needles and in particular to a leather lacing needle.

2. Description of the Prior Art

The type of needle work concerned herein is the lacing of articles such as wallets or purses with strips of leather or leather-like material. The strips of leather may be approximately ⅛ inch wide and approximately 1/32 inch thick. Holes are normally prepunched into the leather article. The lacing is attached to a needle which serves as a guide for the lacing.

Special purpose needles are employed to avoid having a double-back portion of lacing. Conventional household needles with transverse eyes utilize double thicknesses or a double-back portion with no difficulty because of the small diameter of the thread. However, doubling-back of a portion of leather lacing would require undesirably large holes.

One type of lacing needle utilizes an internally threaded socket in the end. The lacing is sharpened to a point and screwed into the threaded socket. The disadvantage of this type of needle is that if the lacing breaks inside the threaded socket, it is difficult to remove.

Another type of lacing needle utilizes a split end. The ends are flexible and have prongs inside them. To thread this needle, the lacing is aligned with the length of the needle and inserted into the spread apart ends. The ends are then pressed or hammered together to drive the prongs into the lacing. A disadvantage of this type of needle is that the ends tend to become sprung, and the prongs bend as well.

U.S. Pat. No. 3,987,839 discloses a needle for general household use that is comprised of two wires soldered or welded at each end. The wires are twisted ¾ of a turn to increase the bias between them. The needle is threaded between the wires by spreading the wires apart and untwisting them. While this needle may be suitable for general household use, it is not satisfactory for lacing because of the twist. It is necessary in leather lacing that the strips of lacing remain untwisted. Such a needle would make it difficult to avoid twisting since the needle would twist as it passes through the hole.

SUMMARY OF THE INVENTION

It is accordingly a general object of this invention to provide an improved leather lacing needle.

It is a further object of this invention to provide a leather lacing needle that is easily threaded and of simple and durable construction.

In accordance with these objects, a leather lacing needle is provided that is comprised of a single piece of stiff wire bent in half. The ends are spot welded or brazed together, with the two halves or portions lying parallel with each other and straight. The needle is threaded by spreading the two portions apart and inserting a length of lacing. The portions are allowed to spring back together, and the lacing is pulled along the needle until contacting the bend. After wedging into the bend, the protruding end of the lacing can be trimmed off flush with the needle.

DESCRIPTION OF THE PREFERRED EMBODIMENT

Figure 1:
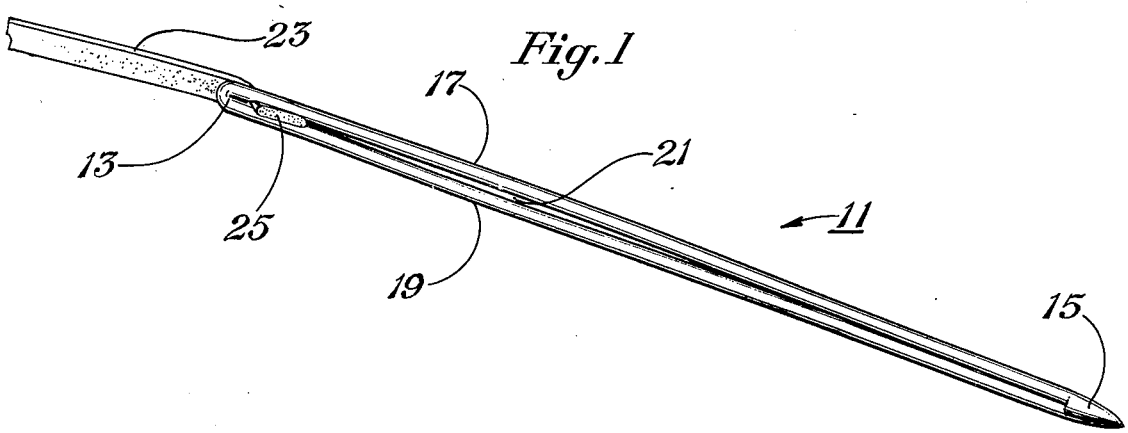
FIG. 1 is a perspective view of a needle constructed in accordance with the teachings of this invention
Figure 2:
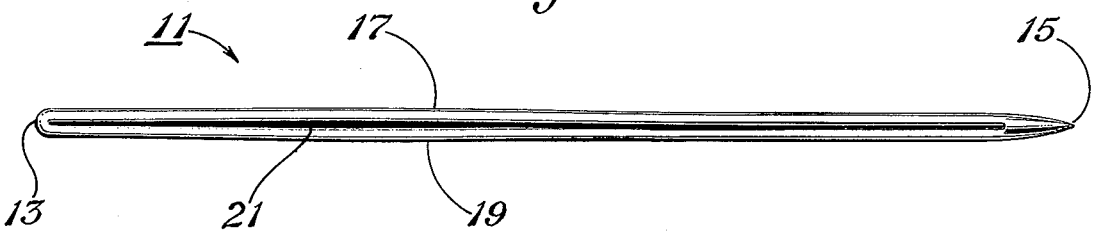
FIG. 2 is a side elevational view of the needle of FIG. 1.

Referring to FIG. 2, needle 11 is shown in its natural state. Needle 11 is comprised of resilient wire such as piano wire. It should be of high carbon steel and have low ductility, but requires the capacity to be flexed and return to its natural state. The diameter of the wire is preferably 0.041 inch.

To construct a needle, a length of straight wire is selected approximately double the length of the desired needle. It is bent 180° at its longitudinal center, as indicated by numeral 13. The ends of the wire are spot welded or brazed together, then deburred to form a point 15, which may be somewhat blunt if desired.

The bend 13 and point 15 define two juxtaposed wire portions 17, 19 of equal length that contact each other along their lengths. Wire portions 17, 19 are straight and parallel with each other. Each lie in a single common plane.

Figure 3:
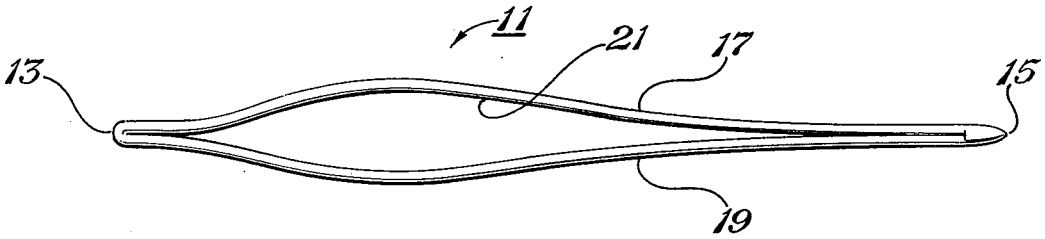
FIG. 3 is a side elevational view of the needle of FIG. 1, with the wire portions spread apart to demonstrate threading.

As shown in FIG. 3, the aperture between the wire portions 17, 19 becomes an elongated eye 21 that extends substantially the length of wire portions 17, 19. For threading, eye 21 is widened by placing ones' thumb nail into it, then drawing the wire portions 17, 19 apart, as shown in FIG. 3. Lacing 23 is inserted into the eye 21 transverse to the length of the needle. The excess end of the lacing should initially protrude ¼ inch to 1 inch on the other side of the needle. The wire portions 17, 19 are then released, allowing them to spring back into position, squeezing the lacing 23 to a certain extent. The needle 11 is then grasped with one hand and the lacing 23 with the other. The lacing is drawn back until it wedges tightly into the bend 13. The excess lacing is trimmed off flush with the sides of the needle, as indicated by numeral 25. Surprisingly, the friction provided by wire portions, 17, 19 at the bend 13 has been found to be sufficient to retain leather lacing under ordinary tensions encountered.

It should be apparent that an invention having significant improvements has been provided. The lacing needle allows lacing without a doubled-back lacing portion. It is less complex and easier to construct than prior art lacing needles. It is also more durable and easier to thread.

While this invention has been described in only one of its forms, it should be apparent to those skilled in the art that it is not so limited, but is subject to various changes and modification without departing from the spirit or scope thereof.

I claim:

1. A method of threading a needle with lacing comprising the steps of:

providing a needle with two resilient wire portions placed parallel to each other, and secured together at both of their ends so that they are inherently biased together and form a point on one end; then spreading the portions apart to define an eye of the needle; then inserting the lacing transversely between the portions with an excess end of the lacing protruding past the portions; then releasing the portions, allowing them to close against the lacing; then drawing the lacing along the eye until it bears against an end opposite the end serving as the point; and then trimming off the excess end of the lacing flush with the side of the needle.

2. The method according to claim 1 wherein the wire portions are straight.

* * * * *